US007610924B1

(12) United States Patent
Boos et al.

(10) Patent No.: US 7,610,924 B1
(45) Date of Patent: Nov. 3, 2009

(54) APPARATUS FOR COATING AND DEPOSIT REMOVAL INSIDE LARGE DIAMETER TUBES

(75) Inventors: Frederick A. Boos, Temple Terrace, FL (US); Scott F. Boos, Tampa, FL (US); Michael W. Charo, Lithia, FL (US)

(73) Assignee: Blasters Technologies, LLC, Tampa, FL (US)

( * ) Notice: Subject to any disclaimer, the term of this patent is extended or adjusted under 35 U.S.C. 154(b) by 541 days.

(21) Appl. No.: 11/279,687

(22) Filed: Apr. 13, 2006

(51) Int. Cl.
*B08B 9/027* (2006.01)
*B08B 3/02* (2006.01)

(52) U.S. Cl. ..... 134/167 C; 134/169 C; 15/304; 15/104.05

(58) Field of Classification Search ..... 134/6, 134/22.11, 22.12, 22.18, 33, 166 C, 167 C, 134/168 C, 169 C; 15/304, 104.05, 104.09
See application file for complete search history.

(56) References Cited

U.S. PATENT DOCUMENTS 4,036,173 A * 7/1977 Nicklas ..... 118/306
4,968,101 A * 11/1990 Bossow ..... 299/41.1
5,244,505 A * 9/1993 Allison et al. ..... 134/22.11
5,389,003 A * 2/1995 Van Steenwyk et al. ..... 439/191
5,622,571 A * 4/1997 Derlein ..... 134/22.11
5,913,977 A * 6/1999 Nichols ..... 118/712
2004/0194809 A1 * 10/2004 Crawford et al. ..... 134/22.12
2005/0210619 A1 * 9/2005 Boos et al. ..... 15/302

* cited by examiner

*Primary Examiner*—Joseph L Perrin
(74) *Attorney, Agent, or Firm*—Ronald E. Smith; Smith & Hopen, P.A.

(57) ABSTRACT

An apparatus for cleaning the interior sidewall of a large diameter tube includes a centrally-apertured circular brush plate adapted to fit within a lumen of the tube. A fluid conduit is mounted in the aperture so that an upper part of the fluid conduit is positioned above a plane of the circular brush plate and a lower part is positioned below the plane. A nozzle assembly is disposed in radial relation to the lower part of the fluid conduit. A hose provides fluid communication between a remote source of water under pressure and the fluid conduit. The circular brush plate is inserted into the lumen of the tube and is gradually advanced through the tube. The nozzle assembly is rotated about an axis defined by the fluid conduit as the circular brush plate is advanced through the tube so that water under pressure cleans the interior sidewall of the tube.

7 Claims, 6 Drawing Sheets

APPARATUS FOR COATING AND DEPOSIT REMOVAL INSIDE LARGE DIAMETER TUBES

FIELD OF INVENTION

This invention relates to cleaning devices. More particularly, it relates to an apparatus that cleans nuclear missile and other large diameter tubes.

SUMMARY OF INVENTION

The long-standing but heretofore unfulfilled need for an apparatus that cleans the interior sidewall of a large diameter tube such as a nuclear missile tube is now met by a new, useful, and nonobvious invention. The inventive structure includes three primary moving parts under hydraulic control. A first primary moving part is a flat, circular brush plate adapted to fit within a lumen of a large diameter tube. The circular brush plate has a disc or generally saucer shape and thus is sometimes referred to as the floating saucer, the flying saucer, or just the saucer. The saucer is raised and lowered within the lumen of the tube at a rate of speed under hydraulic control. An aperture is formed in the saucer, centrally thereof, and a fluid conduit is mounted in the aperture so that an upper part of the fluid conduit is positioned above a plane of the saucer and a lower part of the fluid conduit is positioned below the plane. A hub is in fluid communication with the lower end of the fluid conduit, i.e., the hub is positioned below the plane of the saucer.

At least one nozzle assembly having a spray axis is disposed in radial relation to the hub. A source of water under pressure is disposed in remote relation to the fluid conduit and an elongate, flexible hose is disposed in fluid communication between the source of water under pressure and the fluid conduit. The hub and nozzle assembly are the second of the three primary moving parts. The rotation of the hub and nozzle assembly is under hydraulic control.

An insertion means under hydraulic control inserts the saucer into the lumen at a top end of the tube and gradually advances the saucer to a bottom end of the tube. The insertion means includes a stand including at least three legs adapted to sit atop an uppermost end of the tube. The insertion means further includes an electro-hydraulic power pack, a reel secured to an output shaft of a hydraulic motor for conjoint rotation therewith, and an elongate cable wound in coiled relation about the reel. The elongate cable has a distal free end from which the saucer is suspended so that the saucer is raised when the cable is reeled in and lowered when the cable is played out. The raising and lowering of the saucer is under hydraulic control so that its rate of movement in the up or down direction is controlled by adjusting valves and hydraulic pressure in a way that is well-known in the art of hydraulics.

A hydraulically-powered rotation means rotates the hub and nozzle assembly in a horizontal plane about a vertical axis defined by the hub as the saucer is advanced from the top end to the bottom end of the tube. Water under pressure therefore cleans the interior sidewall of the tube.

An annular brush is secured to the saucer about a radially outward periphery thereof. The brush has a radially outermost end disposed in abutting contact to the sidewall of the tube and inhibits dust and debris from traveling from a closed space below the plane of the saucer to an open space above the saucer. A missile tube equipped with a vacuum source at its lowermost end may be kept debris-free throughout the cleaning process by connecting the vacuum to the area of the tube below the saucer so that paint and other debris blasted from the interior wall of the tube is vacuumed from the lumen of the tube as soon as it is blasted from said wall.

A plurality of truncate cables interconnects the distal free end of the elongate cable and the saucer. Each truncate cable of the plurality of truncate cables has a proximal end connected to the distal end of the elongate cable and has a distal end secured to the saucer at a peripheral edge thereof. Each of the truncate cables is equidistantly and circumferentially spaced with respect to one another about the periphery of the saucer.

A leveling means maintains the saucer in a substantially horizontal plane as it is being inserted in the lumen of the upstanding tube. The leveling means includes a first and a second set of rotatably mounted pneumatic wheels. The first set of wheels rollingly engages the interior sidewall of the tube at a first elevation and the second set of wheels rollingly engages the interior sidewall of the tube at a second elevation. The difference in elevations maintains the saucer in a substantially horizontal plane as it is hydraulically raised or lowered within the lumen of the tube.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
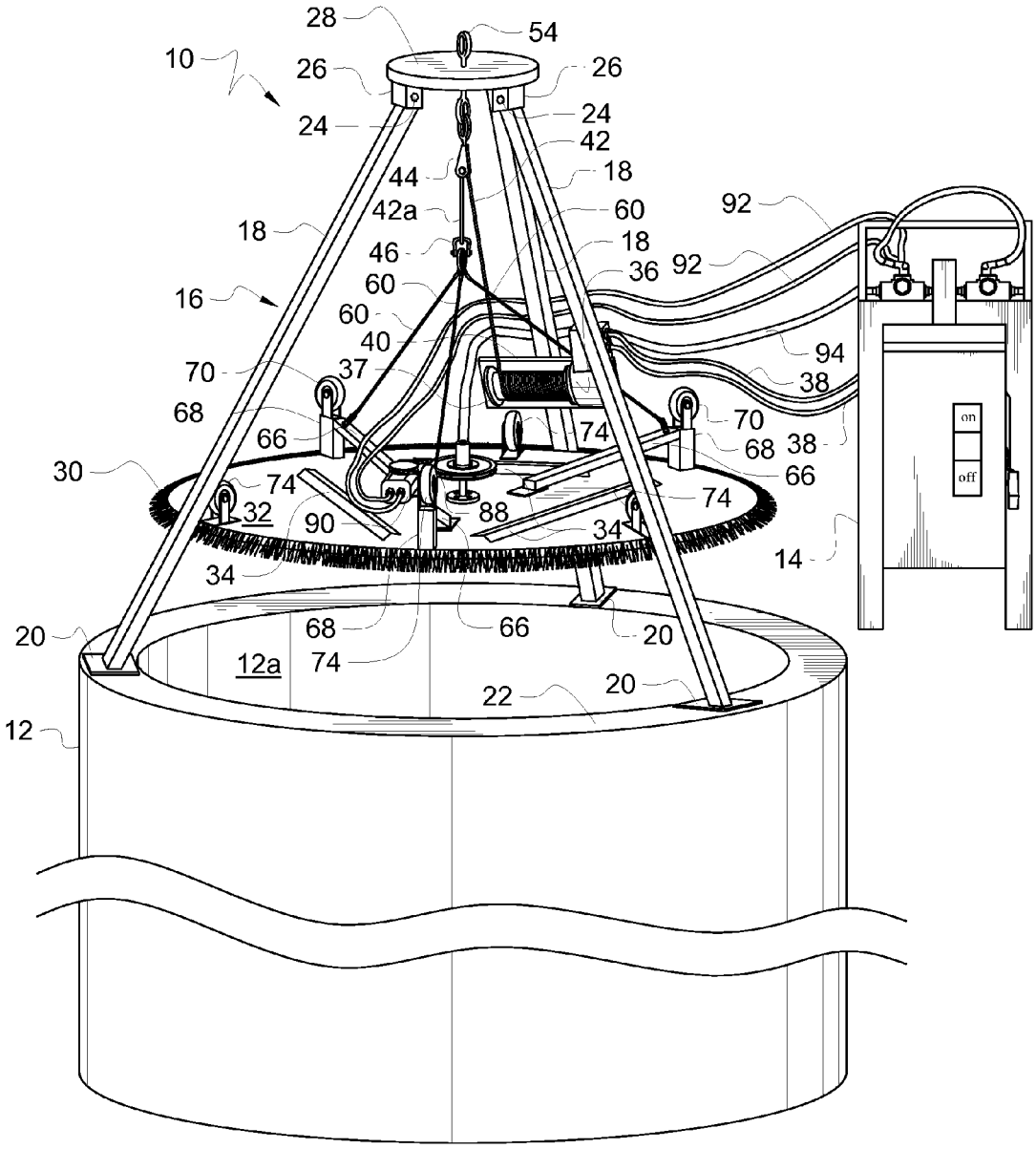
FIG. 1 is a perspective view of the novel apparatus when the brush assembly is about to be inserted into a tube.

As depicted in FIG. 1, novel apparatus 10 is initially positioned above a top end of a large-in-diameter tube 12 that requires cleaning, in axial alignment therewith. In most applications, the tube to be cleaned will be upstanding so that the novel apparatus will be lowered into the lumen of the tube to clean it and raised therefrom when the cleaning is completed. However, the novel apparatus will work even if the tube to be cleaned is oriented in a horizontal plane or some other non-vertical position. In such case, the insertion means described herein would require modification but the principle of operation would remain the same. For example, among other changes the flexible cable would require replacing with a rigid rod or a pulley system.

For a vertically-oriented tube, the insertion means includes an electro-hydraulic power pack 14, and a stand preferably in the form of tripod assembly 16 having legs collectively denoted 18. The stand may have three or more legs. Flat plates, collectively denoted 20, are secured to the respective lower ends of legs 18 and overlie flat top edge 22 of tube 12. Said plates 20 are equidistantly spaced apart from one another and are circumferentially spaced with respect to said flat top edge 22. The respective upper ends of said legs are pivotally secured as at 24 to mounting members 26 that are equidistantly and circumferentially mounted about the periphery of mounting disc 28.

Brushes 30 are preferably of the plastic brush type and are mounted about the periphery of saucer 32. A plurality of stiffeners, which may take the form of angle irons, collectively denoted 34, is secured to the top of saucer 32 to inhibit flexing of said saucer 32. The power to raise and lower saucer 32 is supplied by hydraulic motor 36 that is in communication with electro-hydraulic power pack 14 by means of connectors collectively denoted 38. Electro-hydraulic power pack includes a hydraulic reservoir and an electric motor that generates hydraulic power. The rate of saucer lifting and lowering is thus under hydraulic control.

Hydraulic motor 36 includes an output shaft to which reel 40 is secured for conjoint rotation. Hydraulic motor 36 and reel 37 are mounted to flat mounting plate 40 that may be secured to any preselected leg 18 of said plurality of legs. Cable 42 is in coiled relation to reel 37 and is therefore played out when reel 37 rotates in a first direction and is reeled in when reel 37 rotates in a second direction opposite to said first direction.

Figure 2:
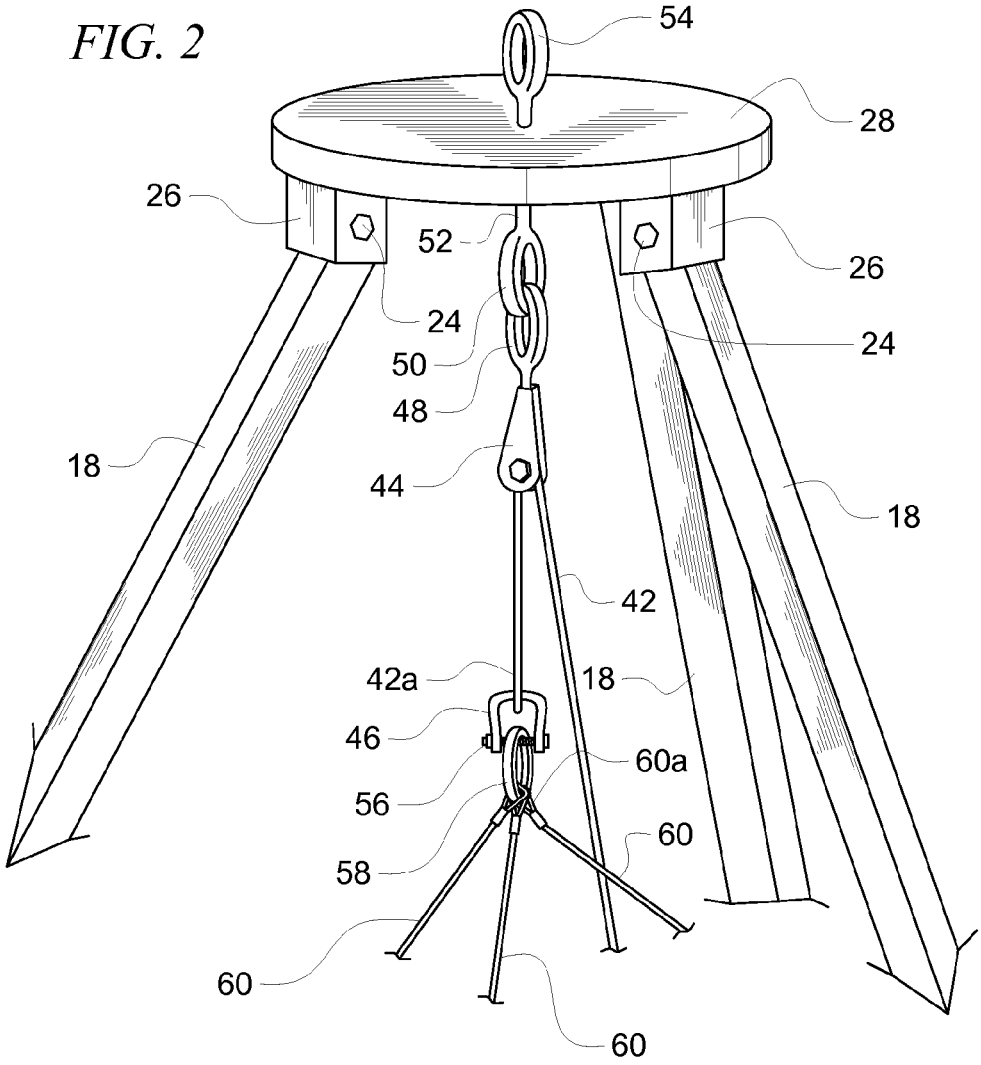
FIG. 2 is a perspective view of the tripod support detailing the pulley and cable attachments.

As best depicted in FIG. 2, the free end of cable 42 extends over a pulley in pulley housing 44 and the distal free end 42*a* of cable 42 is secured to a "U"-shaped connector 46. Pulley housing 44 is supported by link 48 that is supported by link 50 that is formed integrally with rod 52 that extends through a central aperture formed in mounting plate 28 and which terminates in link 54 which is adapted to be engaged by a crane or other means, not depicted, that transports novel assembly 10.

Bolt 56 extends between and interconnects the transversely opposed arms of "U"-shaped connector 46. Ring 58 is captured by said bolt 56. A plurality of cables, collectively denoted 60, is captured by said ring 58 at their respective uppermost ends. More particularly, the uppermost end of each cable 60 terminates in a loop that engages ring 58. Only one of said loops is indicated by reference numeral 60*a* to avoid cluttering of the drawings.

Figure 3:
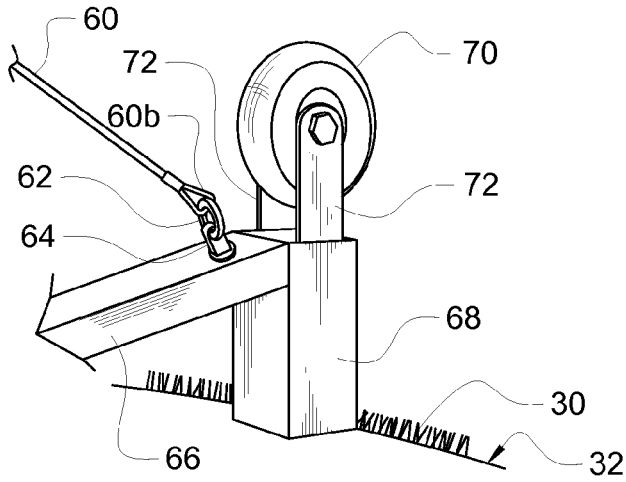
FIG. 3 is a perspective view depicting how the cables are attached to the apparatus.

The lowermost end of each cable 60 is also formed into a loop, denoted 60*b* in FIG. 3. Each loop 60*b* engages a ring 62 that is captured by an opening formed in mounting lug 64. Brace 66 supports mounting lug 64. As best depicted in FIGS. 1 and 3, there are three of such braces and each brace 66 is radially disposed with respect to the center of saucer 32. More particularly, the radially innermost end of each brace 66 is mounted to saucer 32 but said radially innermost end is spaced radially away from the center of said saucer 32. The radially outermost end of each brace 66 is secured to upstanding truncate post 68 that is secured to saucer 32 adjacent its peripheral edge. Pneumatic wheel 70 is rotatably mounted on an axle the opposite ends of which are secured to transversely opposed arms, collectively denoted 72, that are secured to truncate mounting post 68 and which have a height sufficient to enable rotation of said wheel.

Figure 4:
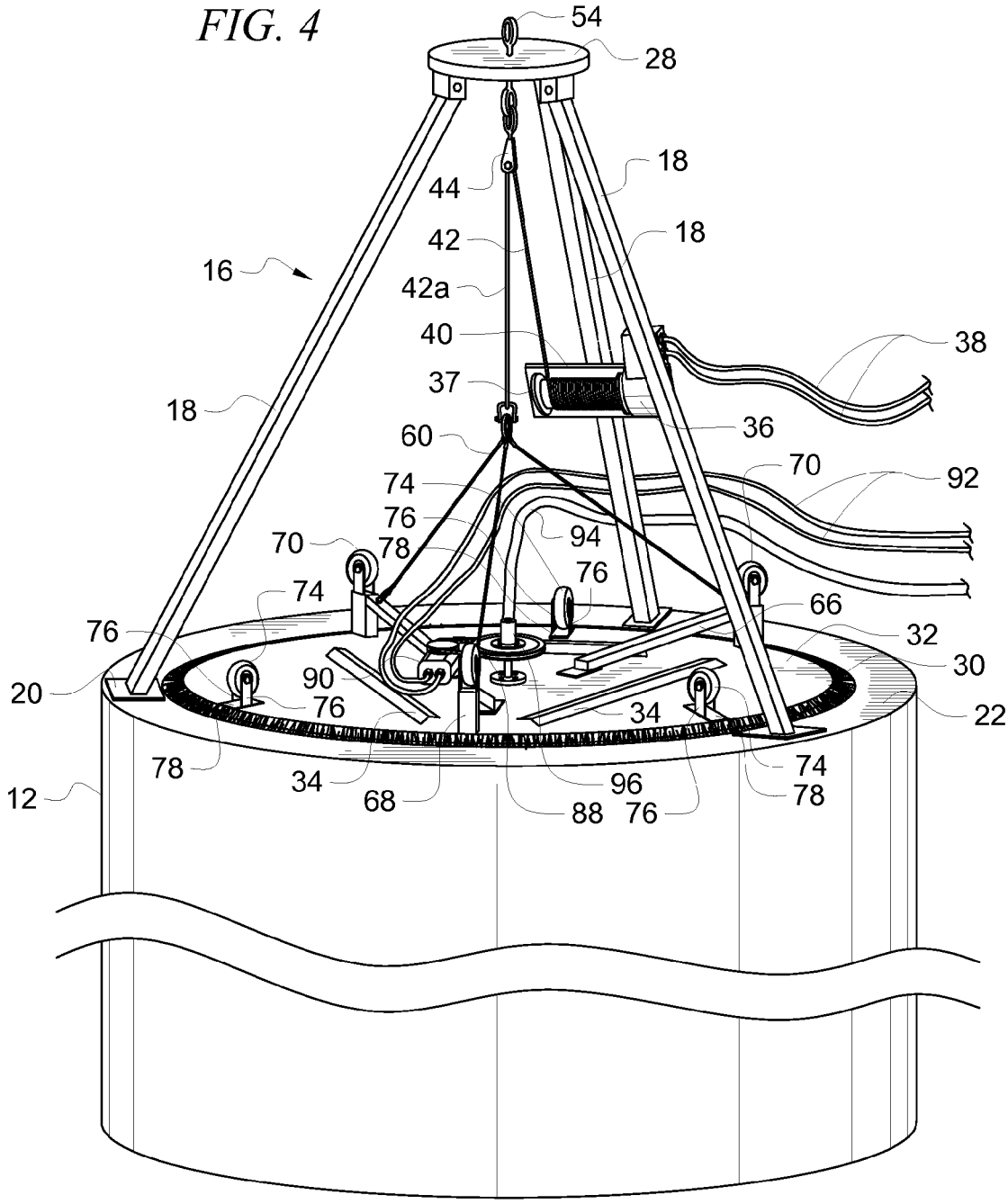
FIG. 4 is the first animation of a three-drawing animation depicting the lowering of the brush into the tube.

As best depicted in FIGS. 1 and 4, there are three of said pneumatic wheels 70 disposed in equidistantly spaced apart relation relative to one another and circumferentially spaced apart relation relative to saucer 32. Another set of rotatably mounted wheels, collectively denoted 74, are also equidistantly spaced apart relative to one another and are also disposed in circumferentially spaced apart relation relative to saucer 32. Each wheel 74 is positioned at a circumferential midpoint between two contiguous wheels 72, i.e., first set of wheels 70 and second set of wheels 74 are equidistantly spaced apart relative to one another and are circumferentially spaced apart relative to saucer 32. However, each wheel 74 of the second set of wheel is rotatably mounted on an axle between two transversely opposed arms, collectively denoted 76, and said arms 76 are secured to flat mounting plates, collectively denoted 78, that lie flat atop and are secured to saucer 32. Thus, each wheel 74 is mounted at a lower elevation than each wheel 70. All wheels are pneumatic so that they conform to any seams, cracks, or other surface irregularities that may be present.

Figure 5:
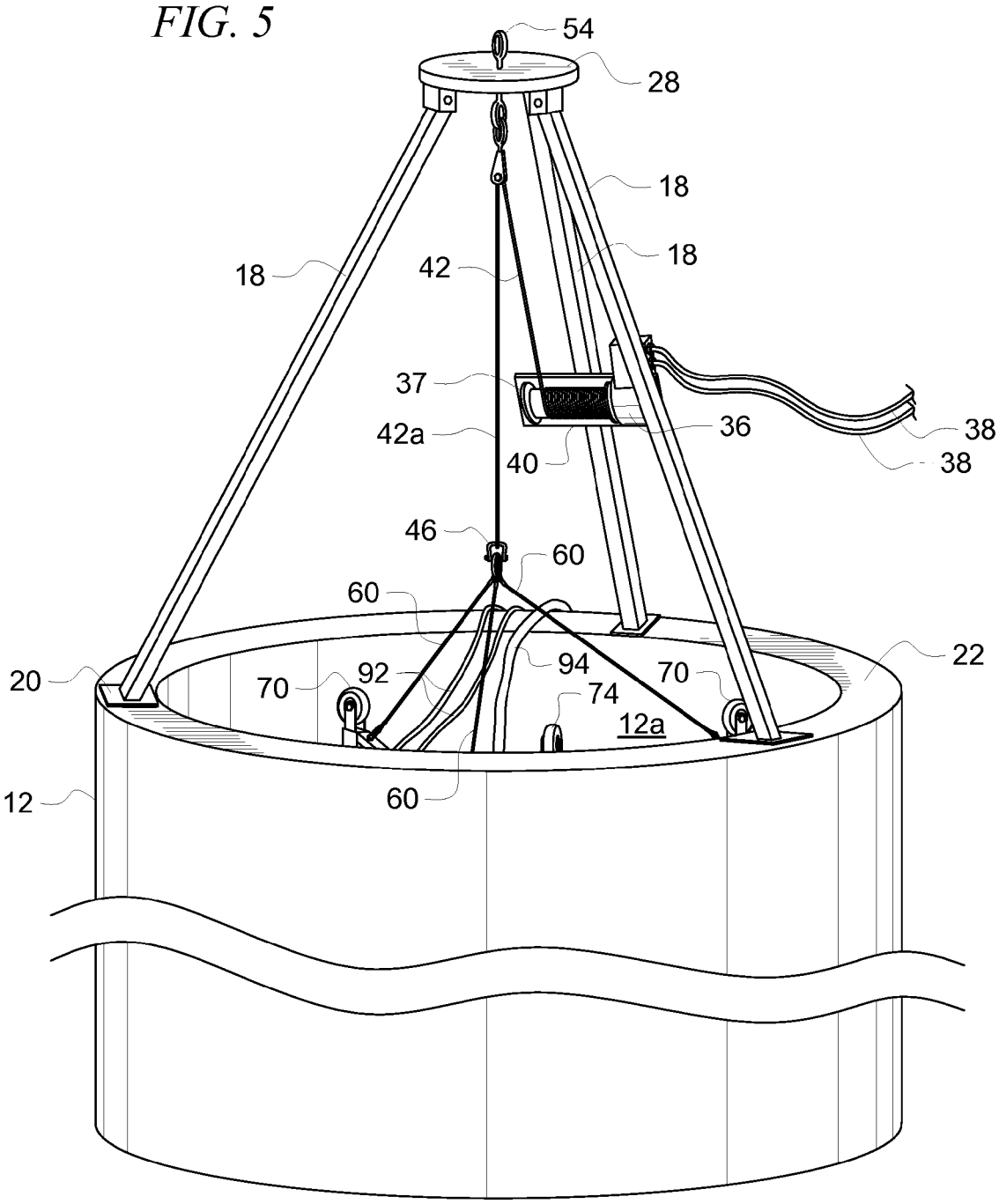
FIG. 5 is the second drawing of said three-drawing animation.
Figure 6:
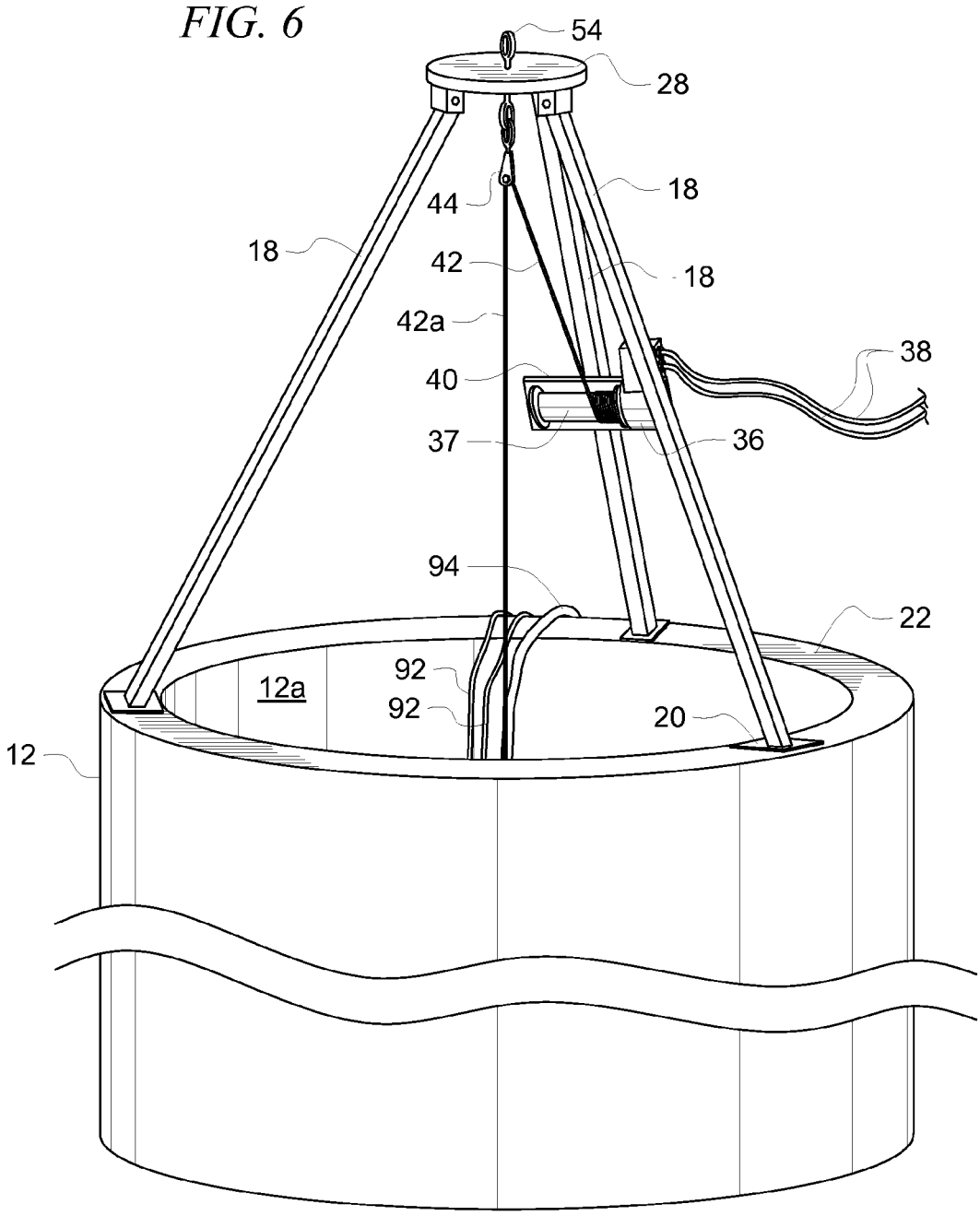
FIG. 6 is the third drawing of said three-drawing animation.

The reason for such difference in elevation of mounts for wheels 70 and 74 is to provide a leveling means for saucer 32 as perhaps best understood in connection with FIGS. 4-6. In FIG. 4, saucer 32 has been lowered from its FIG. 1 position by playing out of cable 42 from reel 37. Saucer 32 is substantially flush with the uppermost end of tube 12 in FIG. 4 and neither upper wheels 70 not lower wheels 74 have engaged the inner wall of said tube. In FIG. 5, more cable 42 has been played out from reel 37 and saucer 32 has therefore descended into the lumen of tube 12 and interior wall 12*a* is now engaged by brush 30 that circumscribes saucer 32. Two upper wheels 70 and one lower wheel 74 can be seen in this FIG. 5. The height-staggering of circumferentially-adjacent wheels serves to hold saucer 32 in a substantially horizontal plane.

Almost all of cable 42 has been played out from reel 37 in the configuration depicted in FIG. 6. Thus it is understood that saucer 32 and brush 30 mounted thereabout are approaching the bottom of tube 12 and the cleaning process is almost complete.

Figure 7:
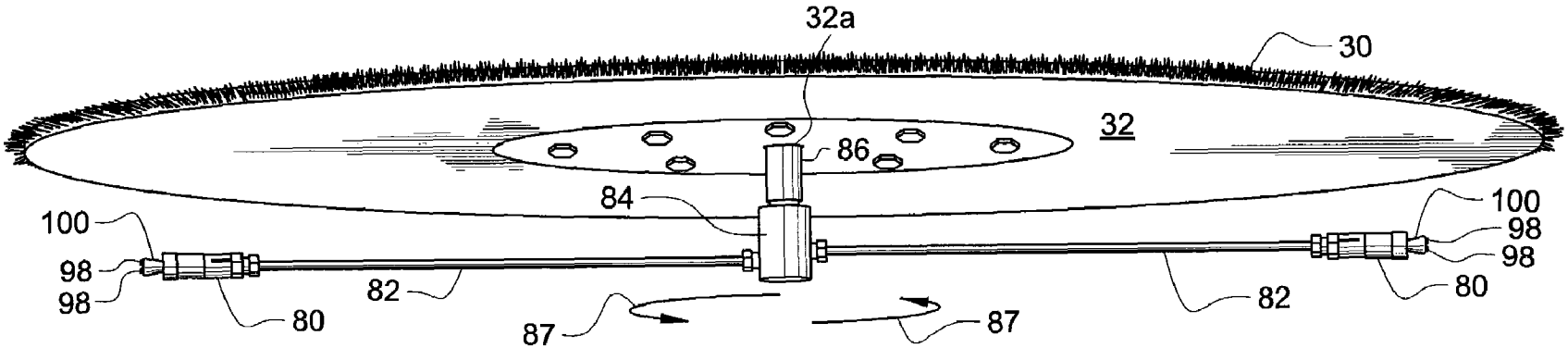
FIG. 7 is a perspective view of the underside of the plate assembly.
Figure 8:
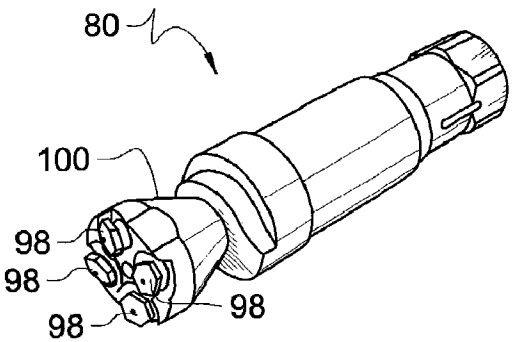
FIG. 8 is a perspective view of a nozzle.

Referring now to FIGS. 7 and 8, it will there be seen that a nozzle assembly of a pair of nozzle assemblies, collectively denoted 80, is respectively mounted to the distal free end of a pair of rigid tubes, collectively denoted 82, and that said nozzle assemblies and rigid tubes are mounted below saucer 32. Rigid tubes 82 are mounted to a central hub 84 in diametrically opposed relation to one another. Nozzle assemblies 80, rigid tubes 82 and hub 84 rotate conjointly with one another under hydraulic control and are collectively the second of said three primary moving parts.

Hub 84 is mounted for rotation, as indicated by directional arrows 87 in FIG. 7. As best understood by comparing FIG. 1 and FIG. 7, hub 84 and therefore tubes 82 are rotated by a hydraulic rotation means that includes connector 86 positioned below saucer 32. Rotation of connector 86 is caused by rotation of pulley 88 that is mounted for rotation on the upper side of said saucer 32. Pulley 88 is denoted by its reference numeral in FIGS. 1 and 4 but the belt that rotates it is not to avoid cluttering of the drawings. The unnumbered belt is driven by hydraulic motor 90 that is in communication with electro-hydraulic power pack 14 by means of connectors 92. Accordingly, the speed of rotation of hub 84 and rigid tubes 82 is hydraulically controlled.

Water under pressure is delivered to nozzle assemblies 80 by hose 94 that is in fluid communication with a source of water under pressure and hub 84. Reference numeral 96 in FIG. 4 denotes a fluid conduit to which the distal end of hose 94 is secured, it being understood that said fluid conduit 96 is in fluid communication with said hub 84 and said nozzle assemblies 80. Accordingly, aperture 32*a* is formed in the center of saucer 32 as depicted in FIG. 7 to accommodate said fluid conduit 96, i.e., fluid conduit 96 is mounted in said aperture 32*a*.

The inside wall 12*a* of tube 12 is cleaned by water under pressure from said nozzle assemblies as said hub 84 rotates.

Each nozzle assembly 80 includes a rotatably mounted nozzle head 100 that includes a plurality of nozzles, collectively denoted 98, that are circumferentially spaced apart from one another and which spin to eject water at differing angles as may be determined by observing the differing orientations of each nozzle 98 in FIG. 8. Each nozzle head 100 is self-rotating, i.e., the rotation is provided by the impulse of the water dispensed from nozzles 98. Since the water pressure is under hydraulic control, the speed of rotation of each nozzle head 100 is under hydraulic control. Each nozzle head is thus understood as the third of the three primary moving parts. Brushes 30 inhibit the escape of dust and debris during the cleaning process but do not perform a substantial part of the cleaning process. Nozzles 98 are self-propelled by water pressure due to the angle of the nozzles as water is emitted at high pressure from said nozzles. Nozzle head 100 spins about the longitudinal axis of its associated nozzle assembly 80, thereby providing more coverage. More particularly, a swath formed by a spinning nozzle head may be from about two to four inches (2"-4"), depending on the standoff distance between the nozzle head and the material being removed from the tube.

All three primary moving parts of the inventive structure are thus understood to be under hydraulic control. The saucer, the rotating hub, rigid tubes, nozzle assemblies, and the spinning nozzle heads are interdependent. Thus, the speed of the saucer as it is lowered may determine the speed of rotation of the hub, the nozzle heads, and the spin of the nozzles. The speeds that are selected are dependent upon the application, i.e., what is being removed from the tubes and how clean the tubes are when the job begins.

The novel assembly accomplishes all of its objectives. In cutting the man-hours for cleaning a plurality of nuclear missile tubes from several thousand hours to three hours per tube, it represents a pioneering breakthrough in the art and the claims that follow are therefore entitled to broad interpretation to protect the heart or essence of the invention.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween. Now that the invention has been described,

What is claimed is:

1. An apparatus for removing coatings and deposits from the interior sidewall of a large diameter tube, comprising:

a non-rotating circular brush plate adapted to fit within a lumen of said large diameter tube;

said circular brush plate being positioned in a plane that is normal to a longitudinal axis of said large diameter tube;

an aperture formed in said circular brush plate, centrally thereof;

a fluid conduit mounted in said aperture so that an upper part of said fluid conduit is positioned above a plane of said circular brush plate and a lower part of said fluid conduit is positioned below said plane;

a hub in fluid communication with said fluid conduit, said hub being in fluid communication with said fluid conduit and said hub being positioned below said plane;

at least one tube having a longitudinal axis disposed in radial relation to said hub;

a nozzle assembly secured to a radially outward end of said at least one tube, said nozzle assembly having a longitudinal axis coincident with the longitudinal axis of said at least one tube so that water emitted by said nozzle assembly water blasts said interior sidewall of said large diameter tube at a ninety degree angle below the plane of said circular brush plate;

a remote source of water under pressure disposed in fluid communication with said upper part of said fluid conduit;

insertion means for inserting said circular brush plate into said lumen at a top end of said tube and for gradually advancing said circular brush plate to a bottom end of said tube;

rotation means for rotating said at least one tube about an axis defined by said hub as said circular brush plate is advanced from said top end to said bottom end of said tube;

a brush secured to said circular brush plate about a periphery thereof;

said brush having a radially outermost end disposed in abutting contact to said sidewall of said tube;

whereby said brush inhibits dust and debris from traveling from a closed space below the plane of said circular brush plate to an open space above said circular brush plate; and whereby water under pressure removes coatings and deposits from said interior sidewall of said large diameter tube.

2. The apparatus of claim 1, further comprising:

said insertion means including a stand including at least three legs adapted to sit atop an uppermost end of said tube.

3. The apparatus of claim 2, further comprising:

said insertion means further including a hydraulic motor, a reel secured to an output shaft of said hydraulic motor for conjoint rotation therewith, an elongate cable wound in coiled relation about said reel, and said elongate cable having a distal free end from which said circular brush plate is suspended so that said circular brush plate is raised when said cable is reeled in and lowered when said cable is played out.

4. The apparatus of claim 3, further comprising:

a plurality of truncate cables that interconnect said distal free end of said elongate cable and said circular brush plate, each truncate cable of said plurality of truncate cables having a proximal end connected to said distal end of said elongate cable and having a distal end secured to said circular brush plate at a peripheral edge thereof, each of said truncate cables being equidistantly and circumferentially spaced with respect to one another about the periphery of said circular brush plate.

5. The apparatus of claim 1, further comprising:

leveling means for maintaining said circular brush plate in a substantially horizontal plane as it is being inserted in the lumen of said upstanding tube.

6. The apparatus of claim 5, further comprising:

said leveling means including a first and a second set of rotatably mounted wheels, said first set of wheels rollingly engaging said interior sidewall of said tube at a first elevation and said second set of wheels rollingly engaging said interior sidewall of said tube at a second elevation, said difference in elevations substantially maintaining said circular brush plate in a substantially horizontal plane.

7. The apparatus of claim 1, further comprising:

said nozzle assembly including a nozzle head;

said nozzle head including a plurality of nozzles formed therein;

said nozzle head being rotatably mounted with respect to a longitudinal axis of said nozzle assembly;

said longitudinal axis of said nozzle assembly being coincident with said longitudinal axis of said at least one tube that is radially disposed with respect to said hub;

said nozzle head rotating under an impulse supplied by water under pressure emitted by said nozzles of said plurality of nozzles.

* * * * *